US005334075A

United States Patent [19]

Kakizaki et al.

[11] Patent Number: 5,334,075

[45] Date of Patent: Aug. 2, 1994

[54] REMOTE CONTROL CAR STEERED UPON MOTOR REVERSAL

[75] Inventors: Katsumi Kakizaki; Taichi Iimura, both of Tokyo, Japan

[73] Assignee: Tomy Company, Ltd., Tokyo, Japan

[21] Appl. No.: 929,953

[22] Filed: Aug. 17, 1992

[30] Foreign Application Priority Data

Aug. 23, 1991 [JP] Japan ..... 3-74870[U]

[51] Int. Cl.[5] ..... A63H 17/28; A63H 17/00; A63H 30/04

[52] U.S. Cl. ..... 446/438; 446/437; 446/456

[58] Field of Search ..... 446/437, 438, 439, 443, 446/454, 456

[56] References Cited

U.S. PATENT DOCUMENTS

| | | | |
|---|---|---|---|
| 4,166,338 | 9/1979 | Asano | 446/456 |
| 4,400,698 | 8/1983 | Wessels et al. | 446/443 X |
| 4,563,626 | 1/1986 | Ohtake | 446/454 X |
| 4,577,528 | 3/1986 | Hanzawa | 446/443 X |
| 4,655,724 | 4/1987 | Law | 446/443 |
| 4,813,907 | 3/1989 | Rissman et al. | 446/438 X |
| 4,850,931 | 7/1989 | Auer | 446/437 |
| 4,892,503 | 1/1990 | Kumazawa | 446/437 X |

*Primary Examiner*—Robert A. Hafer
*Assistant Examiner*—D. Neal Muir
*Attorney, Agent, or Firm*—Staas & Halsey

[57] ABSTRACT

A radio-controlled car capable of making a high-speed turn on the spot is provided. The radio-controlled car provides a controller and a car designed to run forward and turn by changing the direction of rotation of a motor. A first driving wheel is fixedly mounted on one end of a driving shaft of the car and an idly rotatable second driving wheel is mounted on the other end of the driving shaft. A gear mechanism for driving the second driving wheel includes a sun gear mounted on a shaft and planetary gears rotatable around the sun gear on the center of the shaft of the sun gear. The planetary gears are designed to alternately mesh with two gears which rotate in different directions, in accordance with a change in the direction of rotation of the motor. A controller is provided in the radio controlled car and includes a charging circuit for recharging rechargeable batteries therein without requiring a separate charger or having to remove the batteries.

3 Claims, 7 Drawing Sheets

REMOTE CONTROL CAR STEERED UPON MOTOR REVERSAL

BACKGROUND OF THE INVENTION

1. Field of the Invention

The present invention relates to a radio-controlled car. The radio-controlled car is capable of turning on the spot at high speed by changing the direction of rotation of the motor. The radio-controlled car also includes a charging circuit for charging rechargeable batteries therein without requiring a separate charger or removing batteries.

2. Description of the Prior Art

In conventional radio-controlled cars, driving power from a motor, which is rotatable in normal and reverse directions of rotation and mounted on the car, is transmitted to a driving wheel fixedly mounted on one end of a driving shaft and to another driving wheel provided with a clutch and mounted on the other end of the driving shaft. For forward driving, the clutch is connected to drive the driving wheels in the normal direction. When making a turn, the clutch is disconnected to drive only one driving wheel in the reverse direction while freeing the other driving wheel.

To turn the car by driving only one driving wheel in the reverse direction with the clutch disconnected, the car must be switched for backward (reverse) movement. In this case, the turn is not likely to be performed smoothly. Furthermore, since one of the driving wheels remains free, it is impossible to make a high-speed turn.

The advent of radio-controlled cars capable of turning at a high speed on the spot has been required.

SUMMARY OF THE INVENTION

It is an object of the present invention to provide a radio-controlled car that when making a turn, one of the driving wheels turns normally (in a forward direction of rotation) while the other one of the driving wheels turns in a reverse direction (in a backward direction of rotation).

It is another object of the present invention to provide a radio-controlled car which can turn on the spot at high speed.

It is yet another object of the present invention to provide a radio-controlled car with a charging circuit in a controller which does not require a separate charger for recharging a battery.

It is a further object of the present invention to provide charging jacks for both the controller and the car so that it is unnecessary to remove the battery every time the battery needs to be charged.

The above-mentioned objects are obtained by providing a radio-controlled car including a controller for transmitting a digital control signal. The car is constructed to run forward and to turn by changing the direction of rotation of the motor in accordance with the digital control signal. A first driving wheel is fixedly mounted on one end of the driving shaft of the car and a second driving wheel is idly rotatably mounted on the other end of the driving shaft. The gear mechanism which drives the second driving wheel incorporates a sun gear mounted on a shaft and planetary gears rotatable around the sun gear on the center of the shaft. The planetary gears are designed to be alternately engaged with either of the two gears rotating in different directions of rotation in accordance with a change in the direction of rotation of the motor. Therefore, one driving wheel rotates in a normal direction (in a forward direction) and the other driving wheel rotates in a reverse direction (in a backward direction) when making a turn, thereby enabling turning on the spot at high speed.

The battery in the radio-controlled car is rechargeable. A charging circuit for recharging the battery is incorporated in the controller. Since the controller incorporates the charging circuit for recharging the battery, a separate battery charger is not required. Furthermore, it is unnecessary to remove the battery every time recharging is required by providing charging jacks on both the controller and the car for recharging the battery.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENT

An embodiment of the radio-controlled car according to the present invention will be explained in detail with reference to the drawings.

Figure 1:
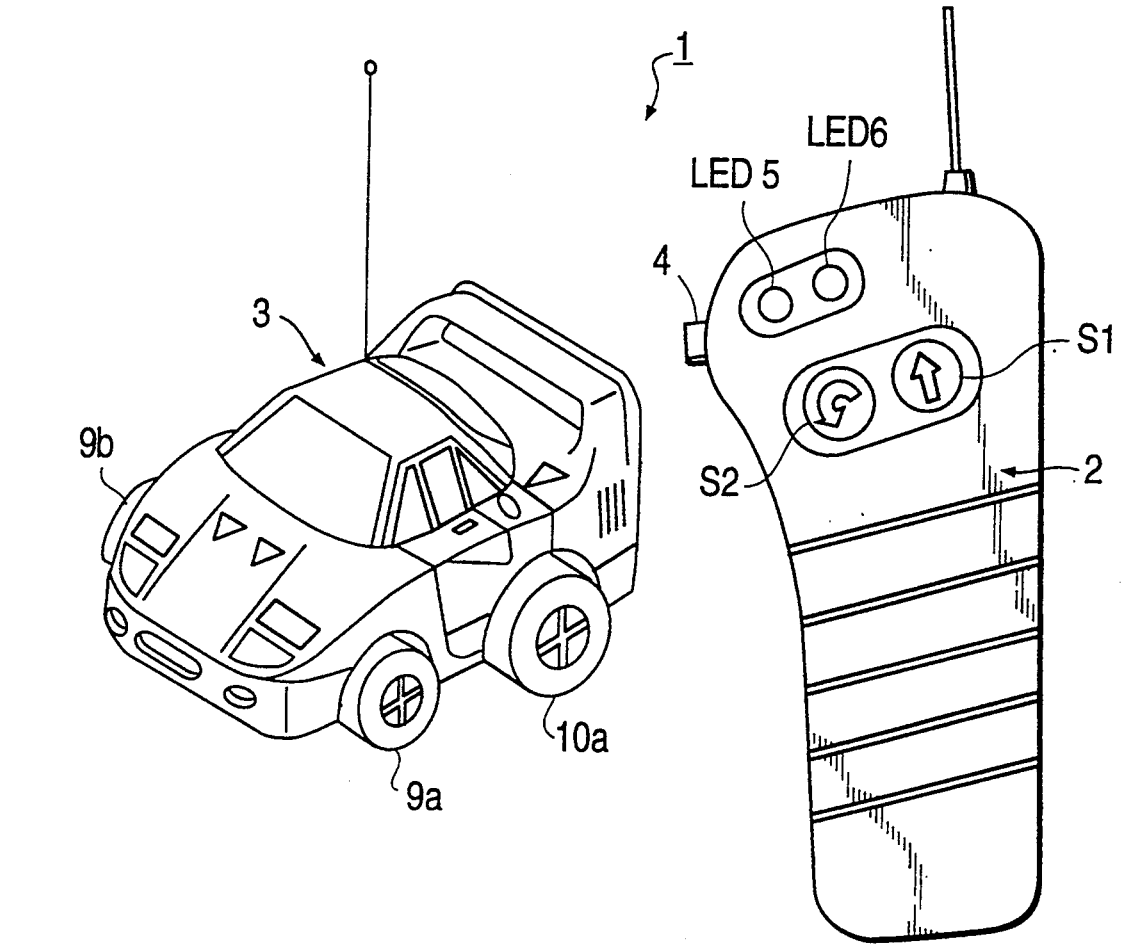
FIG. 1 is a perspective view of a radio-controlled car according to the present invention.

FIG. 1 shows the outside appearance of an example of the radio-controlled car according to the present invention. The radio-controlled car 1 includes a controller 2 which transmits a digital control signal, and a car 3 which receives the digital control signal and travels in accordance with the digital control signal thus received.

The controller 2 is provided with a FORWARD button S1, serving also as a CHARGE button, a TURN button S2 servicing also as a CHARGE button, a CHARGE lamp LED 5, a TRANSMISSION lamp LED 6, and a CHARGE jack 4.

Figure 2:
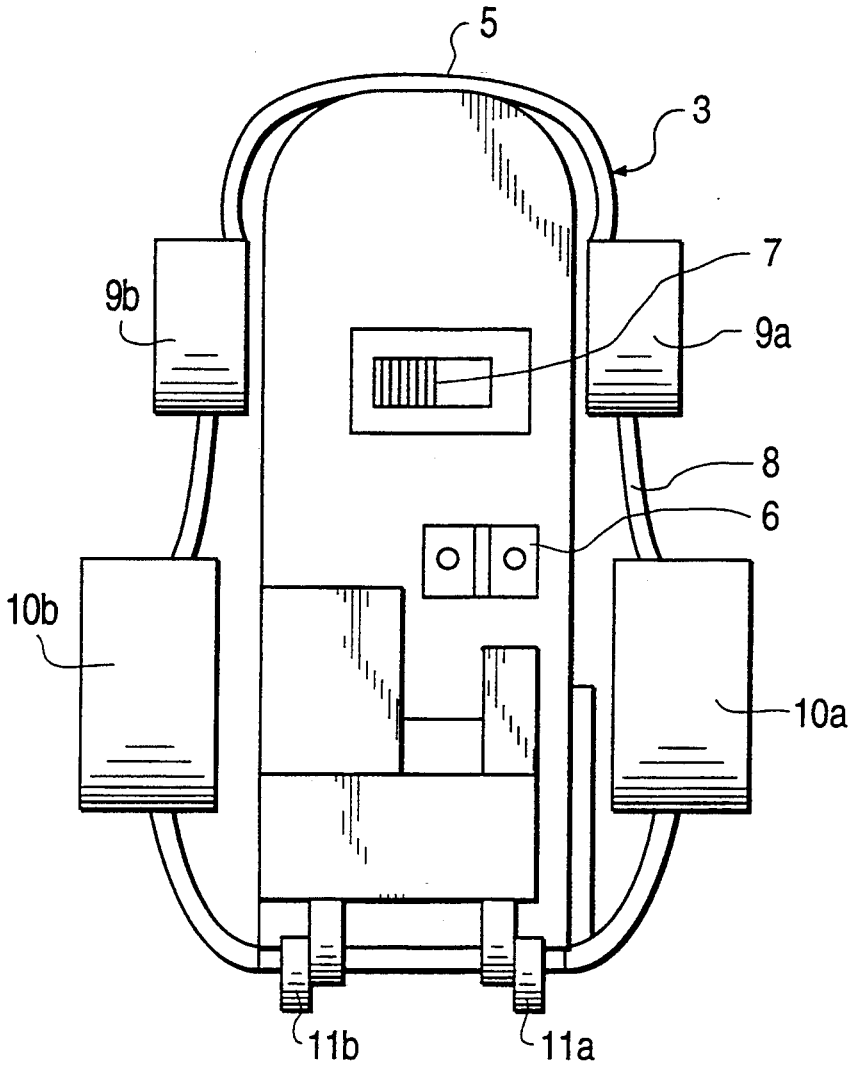
FIG. 2 is a bottom view of the radio-controlled car according to the present invention.

FIG. 2 is an underside view of the radio-controlled car 3. A chassis 5 includes a CHARGE jack 6 and a POWER switch 7.

Figure 3:
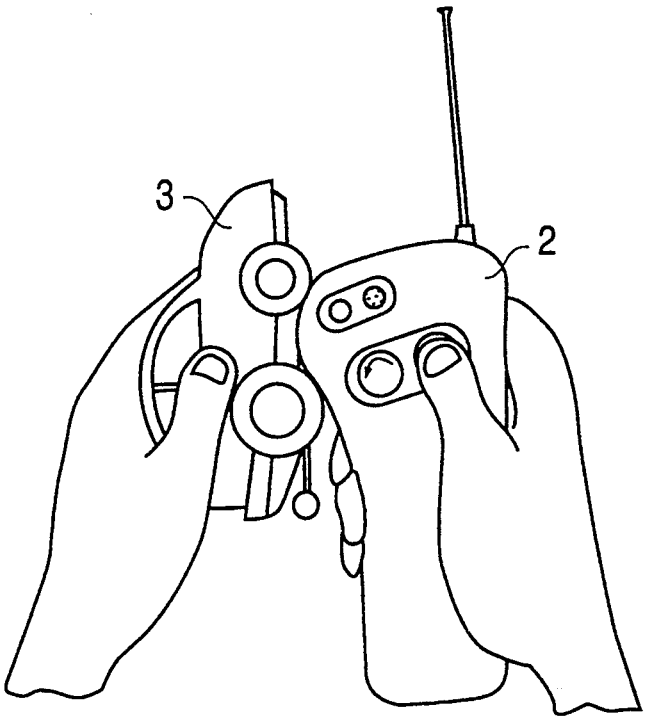
FIG. 3 is a diagram showing how the radio-controlled car according to the present invention is charged.

FIG. 3 shows how the radio-controlled car is charged. A battery (not illustrated) mounted in the car 3 is charged by first turning off the POWER switch 7 mounted on the chassis 5 of the car 3. The controller 2 is coupled to the CHARGE jack 6 under the chassis 5 of the car 3 with the CHARGE jack 4 of the controller 2. Then either one of the FORWARD button S1 or the TURN button S2 of the controller 2 is pushed so that charging occurs.

Figure 4:
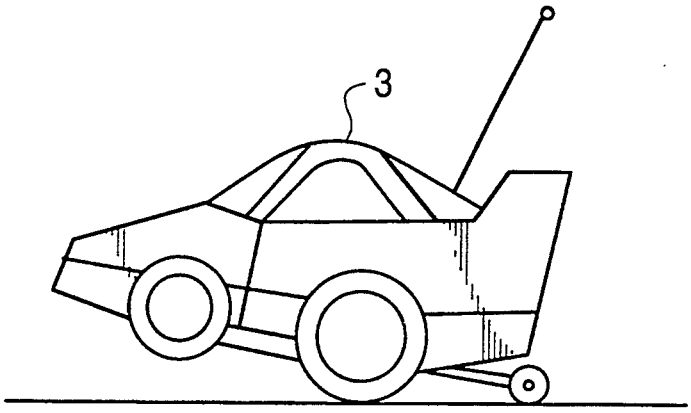
FIG. 4 is a side view of the radio-controlled car according to the present invention during a turn.

After the battery is charged, the controller 2 and the chassis 5 are uncoupled and the POWER switch 7 on the underside of the chassis 5 of the car 3 is turned ON. Then when the FORWARD button S1 of the controller 2 is pushed, the car 3 travels forward while doing a wheelie as shown in FIG. 4.

Figure 5:
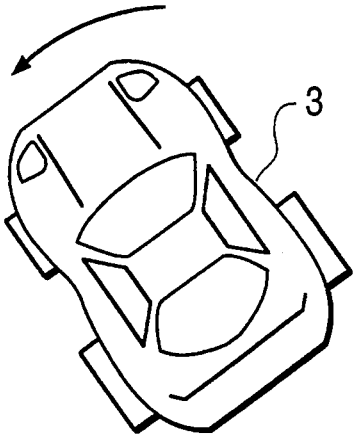
FIG. 5 is a top view of the radio-controlled car according to the present invention during a turn.
Figure 6:
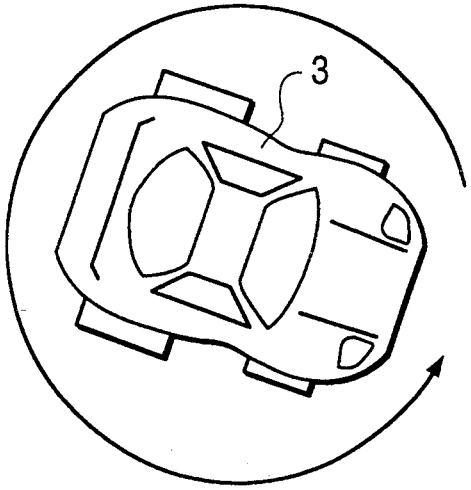
FIG. 6 is a top view of the radio-controlled car according to the present invention during a spin.
Figure 7:
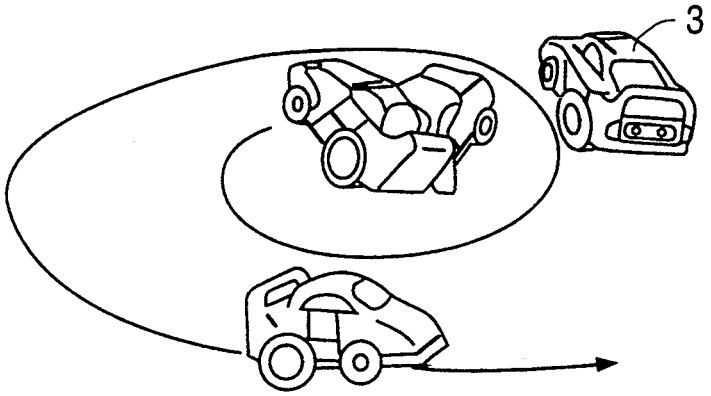
FIG. 7 is a plan view of the radio-controlled car according to the present invention during a spiral running.

In the meantime when the TURN button S2 is depressed and let go, the car 3 turns left on the spot as shown in FIG. 5. Also, when the TURN button S2 is kept depressed, the car starts spinning on the spot as shown in FIG. 6. Furthermore, when the FORWARD button S1 is depressed after the spinning, the car 3 does a wheelie in a spiral as shown in FIG. 7. The headlamps of the car 3 are also turned on when the car moves forward and turns.

Figure 8:
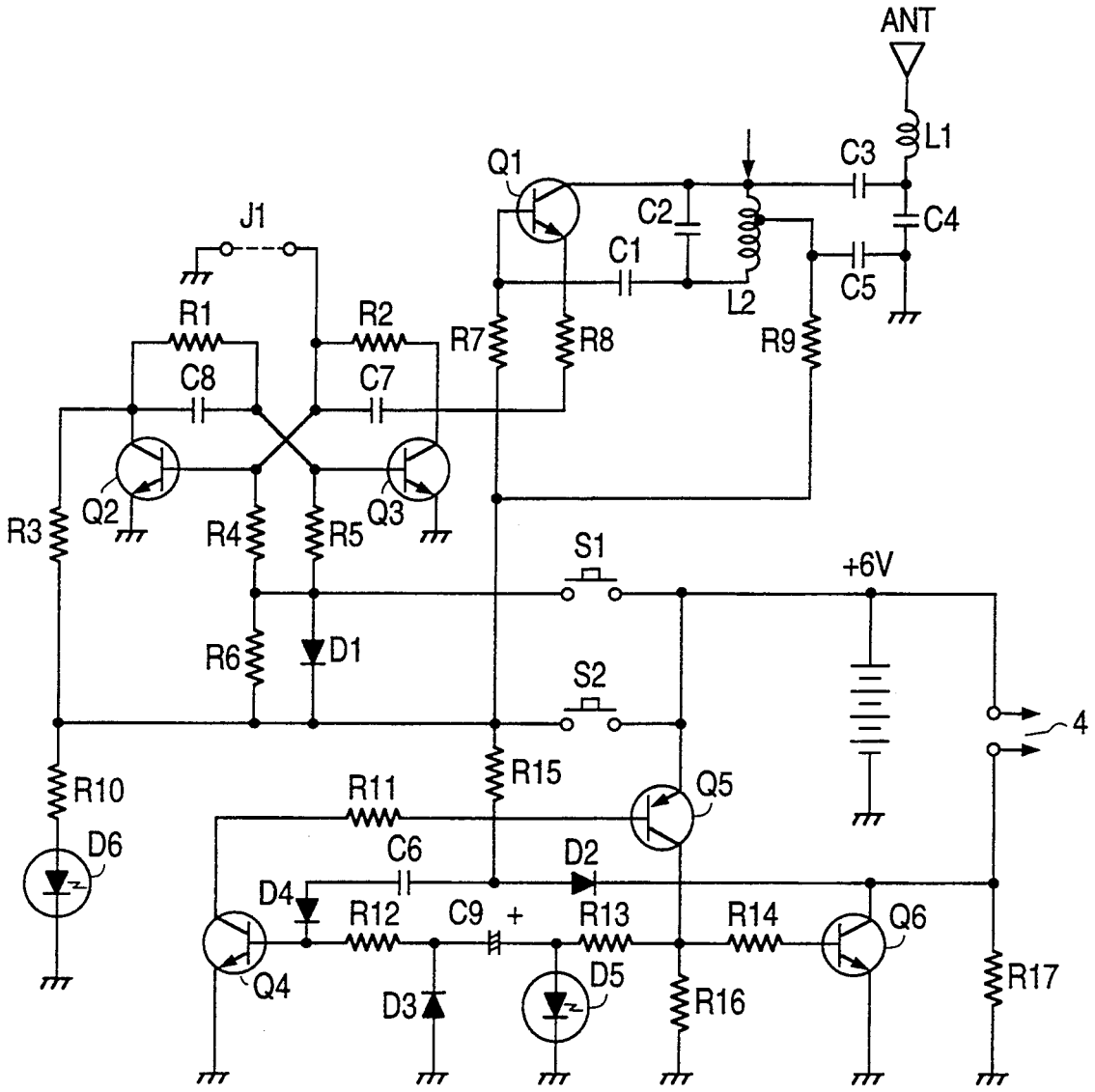
FIG. 8 is a circuit diagram of a controller in the radio-controlled car according to the present invention.

Next, the construction of the radio-controlled car 1 will be described in detail. FIG. 8 is a circuit diagram of the interior of the controller 2, which includes a signal transmission circuit and a charging circuit.

The signal transmission circuit includes transistors Q2 and Q3, resistors R6, R4, R5, R1 and R2, and capacitors C8 and C7, which form an ostable multivibrator. That is, when the switch S2 is depressed, a square-wave pulse is generated having an oscillation frequency determined by resistors R6 and R4 and capacitor C7, and resistors R6 and R5 and capacitor C8. When the switch S1 is depressed, a square-wave pulse is generated having an oscillation frequency determined by resistor R4 and capacitor C7, and resistor R5 and capacitor C8. As shown, the collector of the transistor Q3 is connected to the emitter of transistor Q1 through the resistor R8.

Transistor Q1, capacitors C1 and C2 and inductor 19 form a variation of a Hartley oscillator. When the oscillator and the aforesaid astable multivibrator are operated during switching, a specific signal is outputted from transistor Q1.

Capacitors C3 and C4 and inductor L1 are connected to the output side of transistor Q1 and form an antenna matching circuit for matching an antenna ANT with transistor Q1. That is, the imaginary part of the impedance (reactance) of the antenna ANT and transistor Q1 is cancelled, and the output of transistor Q1 is effectively sent to the antenna ANT.

Capacitor C5 refers to a bypass condenser. A decoupling circuit is composed of capacitor C5 and resistor R9. In this signal transmission circuit, when either one of the FORWARD button S1 and the TURN button S2 is depressed, a TRANSMISSION lamp D6 (LED 6 on the controller 2) turns on indicating that the circuit is "under transmission."

The charging circuit will now be explained. In the charging circuit, when either one of the FORWARD button S1 and the TURN button S2 is depressed, the voltage (+6 V) is differentiated by resistor R15 and capacitor C6. A pulse voltage is applied to the base of transistor Q4 through diode D4, instantly turning on transistor Q4. Thus, electric current flows through the emitter and base of transistor Q5 and resistor R11, operating transistor Q5.

The electric current entering the emitter of transistor Q5 flows into a time-constant circuit including resistors R13 and R12 and capacitor C9, simultaneously becoming the base current of transistor Q4. That is, the electric current flows through the emitter of transistor Q5, the collector of transistor Q5, the time constant circuit R13, C9, R12, and the base and emitter of transistor Q4. When the current is input to the base of transistor Q4, the current at the collector of transistor Q4 forms a loop of electric current flowing for a period of time determined by the time-constant circuit. At the same time, the current at the emitter of transistor Q5 flows into the base of transistor Q6 through resistor R14, thus energizing transistor Q6. Therefore, the battery connected to the charging jack 4 of the controller 2 through the charging jack 6 of the car 3 is charged at a high rate for a period of time equal to the time constant determined by the time constant circuit. The battery is trickle-charged (continuously charged at a low rate) through resistor R17.

After the charging period determined by the time constant, the capacitor C9 is fully charged and the electric current at the base of transistor Q5 will not flow. Accordingly, transistor Q4 will become off. At the same time, when the electric current stops flowing from the base of transistor Q5, the emitter current of transistor Q5 is also stopped.

Subsequently, the capacitor C9 starts discharging. That is, electricity is discharged through the path including capacitor C9 (+), resistors R13 and R16, diode D3 and C9 (−), and the path including C9 (+), resistor R14, the base of transistor Q6, the emitter of transistor Q6, the diode D3 and the capacitor C9 (−).

The battery is charged during the charge time and the discharge time of the capacitor C9. The CHARGE lamp D6 is lit only during the charge time of capacitor C9.

The car 3 will now be explained. The car 3 includes a chassis 5 and a body 8 mounted on the chassis 5. The chassis 5, as shown in FIG. 2, has front wheels 9*a* and 9*b*, rear wheels (driving wheels) 10*a* and 10*b*, and auxiliary wheels 11*a* and 11*b*. The chassis 5 has a rechargeable battery (e.g., a nickel-cadmium storage battery) mounted therein along with a motor 12 which can be driven in normal and reverse directions of rotation by power from the battery (see FIG. 9), and a gear mechanism 20 which drives the rear wheels 10*a* and 10*b* with a driving power from the motor 12 (see FIG. 9). Furthermore, the chassis 5 is also provided with a receiver (not shown) which receives a digital control signal from the controller 2 and controls the motor 12 in accordance with the digital control signal.

Figure 9:
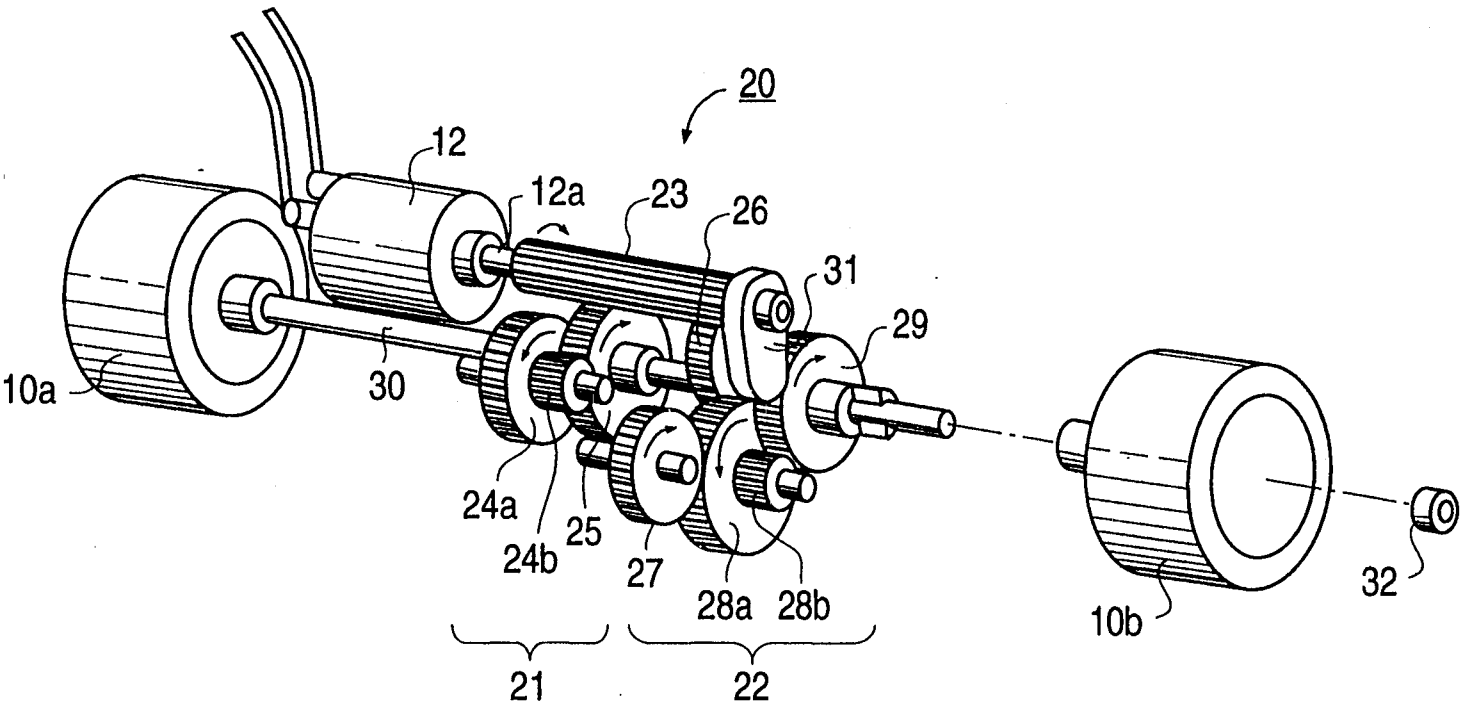
FIG. 9 is a perspective view of a gear mechanism and its periphery of the radio-controlled car according to the present invention.

As shown in FIG. 9, the left rear wheel 10*a* is fixedly mounted on a driving shaft 30, while the right rear wheel 10*b* is idly rotatably mounted on the driving shaft 30, or vice versa.

The gear mechanism 20 may be classified largely into a gear mechanism 21 for driving the left rear wheel and a gear mechanism 22 for driving the right rear wheel. The gear mechanism 21 for driving the left rear wheel comprises a driving gear 23 fixedly mounted on the motor shaft 12*a* a large-diameter gear 24*a* in mesh with the driving gear 23, a small-diameter gear 24*b* rotating as one body with the large-diameter gear 24*a*, and a gear 25 in mesh with the small-diameter gear 24*b* and fixed on the driving shaft 30.

The gear mechanism 22 for driving the right rear wheel comprises the above-described driving gear (sun gear) 23, a planetary gear 26 in mesh with the driving gear 23 and mounted on an arm 31 which is swingably installed on the end of a motor shaft 12*a*, a gear 27 which meshes with the planetary gear 26 during normal rotation of the motor 12, a large-diameter gear 28*a* which is in constant mesh with the gear 27 and with the planetary gear 26 during reverse rotation of the motor 12, a small-diameter gear 28*b* rotating as one body with the large-diameter gear 28*a*, and a final gear 29 which is in mesh with the small-diameter gear 28*b* and freely mounted on the driving shaft 30. The right rear wheel 10*b* is engaged with the final gear 29.

The gear mechanism 22 for driving the right rear wheel 10*b* functions as follows. When the motor 12 is rotating in a normal direction, the arm 31 swings to move the planetary gear 26 into mesh with the gear 27 to transmit the driving power of the motor 12 to the right rear wheel 10*b* through the gears 23, 26, 27, 28*a*, 28*b* and 29, thereby driving the right rear wheel 10*b* in a forward direction. On the other hand, when the motor 12 is rotating in a reverse direction, the arm 31 swings to move the planetary gear 26 into mesh with the gear 28*a* to transmit the power to the right rear wheel 10*b* through the gears 23, 26, 28*a*, 28*b* and 29, thus also turning the right rear wheel 10*b* in a forward direction. That is, the right rear wheel 10*b* rotates forward regardless of the direction of rotation of the motor 12. In the meantime, the left rear wheel 10*a* rotates in a forward direction when the motor 12 rotates in a normal direction, and rotates in a backward direction when the motor 12 rotates in a reverse direction. Therefore, the car 3 runs forward during the normal rotation of the motor 12, and makes a left turn when the motor 12 turns in a reverse direction.

Figure 10:
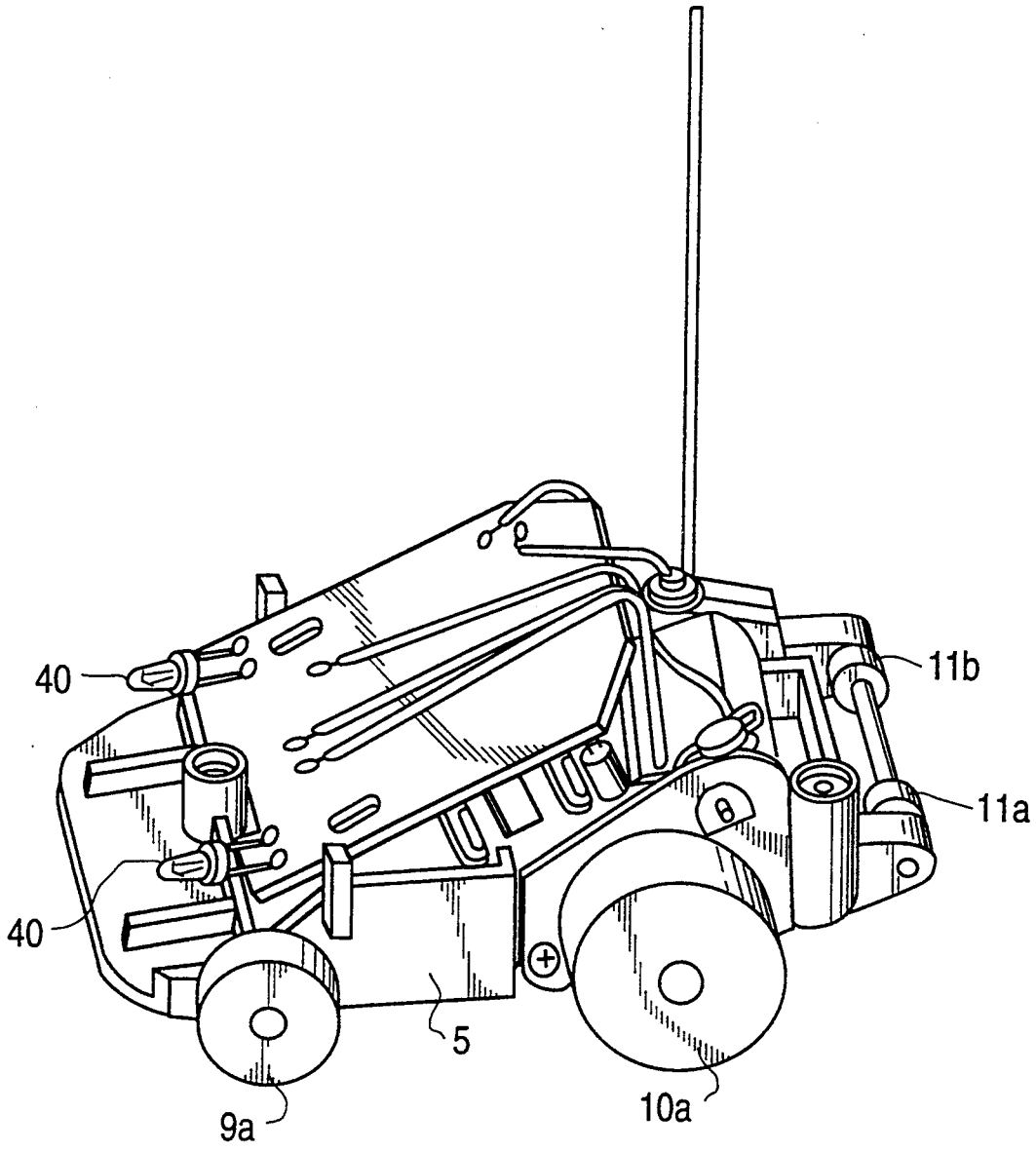
FIG. 10 is a perspective view of the chassis of the radio-controlled car according to the present invention.

The chassis 5 of the car 3 is also provided with lamps (headlights) 40, as shown in FIG. 10. These lamps 40 are lit during travel.

The radio-controlled car 1 of the present invention provides the following advantages. According to the radio-controlled car 1 of the present invention, the right rear wheel 10*b* turns normally (in a forward direction) while the left rear wheel 10*a* turns reversely (in a backward direction) when the car 1 makes a turn. Therefore, the car can turn on the spot and at high speed. Furthermore, since the controller 2 incorporates a charging circuit for charging the battery, it is unnecessary to have a separate charger. Also, since a charging jack is installed in either, or both, the controller 2 and the car 3, it is unnecessary to remove the battery for charging. Because the headlamps are lit during a high-speed spin, the car looks like a flying saucer making a landing and takeoff.

The present invention has been described with particular reference to the embodiment of the radio-controlled car according to the present invention, but it should be understood that the present invention is not limited only to the embodiment described above, and various variations and modifications may be effected within the spirit and scope of the present invention.

What is claimed is:

1. A radio-controlled car having a controller for transmitting a digital control signal, and constructed to travel forward and make a turn by changing the direction of rotation of a motor in accordance with the digital control signal, said radio-controlled car comprising:

a driving shaft operatively connected to the motor;

a first driving wheel fixedly installed on one end of said driving shaft, said first driving wheel rotating in a forward direction regardless of the direction of rotation of the motor;

a second driving wheel idly rotatably mounted on the other end of said driving shaft, said second driving wheel rotating in a forward when the motor rotates in a normal direction and rotating in a reverse direction when the motor rotates in a reverse direction;

a sun gear mounted on a shaft and connected to the motor;

planetary gears rotatably mounted around said sun gear on the center of the shaft of said sun gear, said sun gear and said planetary gears being incorporated in a gear mechanism for driving said second driving wheel, said planetary gears alternately engaged with two gears arranged in different directions in accordance with a change in direction of rotation of the motor;

a rechargeable battery; and a controller, including:

a built-in charging circuit for recharging said rechargeable battery;

a charging jack provided on said controller and said car;

a signal transmission circuit, comprising:

an astable multivibrator an oscillator operatively connected to said astable multivibrator;

an antenna matching circuit operatively connected to said oscillator; and a decoupling circuit;

a charging circuit operatively connected to said signal transmission circuit, comprising:

time-constant circuit means for providing a time constant for determining the rate at which said rechargeable battery is charged;

forward button means for making the car go forward;

turn button means for making the car turn, said turn button also being a charge button;

a transmission light; and a charge light.

2. A radio-controlled car according to claim 1, wherein said transmission light and charge light comprise LEDs.

3. A radio-controlled car as claimed in claim 1, wherein said charging circuit trickle charges said rechargeable battery.

* * * * *